US008919603B2

(12) United States Patent
Greene

(10) Patent No.: US 8,919,603 B2
(45) Date of Patent: Dec. 30, 2014

(54) DETACHABLE HANDLE FOR A DRINKING DEVICE

(75) Inventor: Brian M. Greene, North Easton, MA (US)

(73) Assignee: Learning Curve Brands, Inc., Dyersville, IA (US)

( * ) Notice: Subject to any disclaimer, the term of this patent is extended or adjusted under 35 U.S.C. 154(b) by 700 days.

(21) Appl. No.: 12/377,288

(22) PCT Filed: Sep. 7, 2007

(86) PCT No.: PCT/US2007/077901

§ 371 (c)(1), (2), (4) Date: Feb. 12, 2009

(87) PCT Pub. No.: WO2008/031046

PCT Pub. Date: Mar. 13, 2008

(65) Prior Publication Data

US 2010/0213206 A1 Aug. 26, 2010

Related U.S. Application Data

(60) Provisional application No. 60/825,043, filed on Sep. 8, 2006.

(51) Int. Cl.
*A47G 23/02* (2006.01)

(52) U.S. Cl.
CPC ..... *A47G 23/0216* (2013.01)
USPC ..... 220/752; 294/16; 294/29; 294/30; 294/31.1; 294/33; 215/396; 220/754; 220/756; 220/757; 220/769; 220/772

(58) Field of Classification Search
CPC ..... A41G 23/0216
USPC ..... 220/752, 754, 756, 757, 769, 772; 294/29, 30, 31.1, 33; 215/396
See application file for complete search history.

(56) References Cited

U.S. PATENT DOCUMENTS

| | | | | |
|---|---|---|---|---|
| 2,421,509 | A * | 6/1947 | Knapp | 294/31.1 |
| 2,522,243 | A * | 9/1950 | Wieland | 294/33 |
| 3,261,635 | A * | 7/1966 | Talay | 294/29 |
| 3,311,252 | A * | 3/1967 | Swartwood et al. | 215/397 |
| 3,718,360 | A * | 2/1973 | Knutzen | 294/27.1 |

(Continued)

OTHER PUBLICATIONS

International Search Report and Written Opinion, PCT/US07/77901, mailed Mar. 4, 2008.

(Continued)

*Primary Examiner* — Elizabeth Volz
(74) *Attorney, Agent, or Firm* — Michael Best & Friedrich LLP

(57) ABSTRACT

A detachable handle for a child's sippy cup. The sippy cup includes a cup portion and a lid portion coupled to the cup portion. The lid portion includes a drinking spout having apertures. The detachable handle includes a ring portion that engages the lid and/or the cup portion, and a pair of grasping portions that extend axially and radially away from the ring portion. Hook portions are radially aligned with, and extend axially opposite the grasping portions, and are engageable with an upper surface of the lid portion. Moving the grasping portions radially inwardly causes the hook portions to move radially outwardly for disengagement from the upper surface and removal of the handle from the sippy cup.

17 Claims, 8 Drawing Sheets

(56) References Cited

U.S. PATENT DOCUMENTS

| | | | | | |
|---|---|---|---|---|---|
| 3,809,285 | A * | 5/1974 | Unger et al. | 220/759 |
| 3,990,596 | A * | 11/1976 | Hoftman | 215/11.1 |
| 4,127,915 | A * | 12/1978 | Logan et al. | 294/33 |
| 4,923,234 | A * | 5/1990 | Fairley | 294/99.2 |
| 4,943,017 | A | 7/1990 | Ennis | |
| 5,110,167 | A * | 5/1992 | Friend | 294/16 |
| 5,480,043 | A * | 1/1996 | Wingo | 215/11.1 |
| 5,482,215 | A * | 1/1996 | Veres | 241/1 |
| 5,692,630 | A * | 12/1997 | Hsu | 215/396 |
| 6,325,237 | B1 * | 12/2001 | Gish | 220/737 |
| D460,322 | S | 7/2002 | Orr et al. | |
| 6,959,827 | B2 | 11/2005 | Morano et al. | |
| 6,978,908 | B2 * | 12/2005 | Morano et al. | 215/396 |
| 7,431,169 | B2 * | 10/2008 | Ishikawa et al. | 215/396 |
| 7,686,183 | B2 * | 3/2010 | Ziegler | 220/740 |
| 2001/0027956 | A1 * | 10/2001 | Bonacorso et al. | 215/11.1 |
| 2004/0200851 | A1 | 10/2004 | Wooderson | |
| 2005/0056611 | A1 | 3/2005 | Hakim | |
| 2005/0056614 | A1 * | 3/2005 | Morano et al. | 215/396 |
| 2007/0278172 | A1 | 12/2007 | Hakim | |
| 2010/0213206 | A1 * | 8/2010 | Greene | 220/752 |

OTHER PUBLICATIONS

Canadian Office action for Canadian Application No. 2661846 dated Sep. 10, 2013.

Canadian Office action for Canadian Application No. 2661846 dated May 29, 2013.

Canadian Office action for Canadian Application No. 2661846 dated Jun. 6, 2014.

* cited by examiner

DETACHABLE HANDLE FOR A DRINKING DEVICE

CROSS REFERENCE TO RELATED APPLICATIONS

This application claims the benefit and priority of U.S. Provisional Patent Application No. 60/825,043, filed Sep. 8, 2006.

BACKGROUND OF THE INVENTION

The present application relates generally to drinking devices and more specifically to drinking devices adapted for use by children, such as those sometimes referred to as "sippy cups."

During the early years, when children are transitioning from drinking out of bottles to drinking out of cups, many parents have come to appreciate the benefits of so-called "sippy cups." Sippy cups are drinking devices that include a cup portion that holds a beverage, and a lid portion covering the cup portion. The lid portion may be detachable from the cup portion and is provided with a drinking spout. The drinking spout often includes holes, slots, or other flow-limiting features. The flow-limiting features reduce the amount of spilling that occurs if the sippy cup becomes inverted or is otherwise overturned, but allow liquid flow for drinking when suction is applied to the drinking spout.

SUMMARY OF THE INVENTION

In one embodiment, the invention provides a child's drinking container including a cup, a lid, and a handle. The cup includes a mouth defining an opening. The lid is removably coupled to the cup to overlie the opening, and defines a drinking portion. The handle is removably coupled to at least one of the cup and the lid, and is removable therefrom while the lid is coupled to the cup.

In another embodiment, the invention provides a detachable handle for a child's drinking container. The handle includes a ring portion that defines an axis and that is adapted to receive the drinking container. The handle also includes a pair of hook portions that depend from the ring portion, and a pair of grasping portions that also depend from the ring portion. The hook portions move in response to movement of the grasping portions to afford detachment of the handle from the drinking container.

Figure 1:
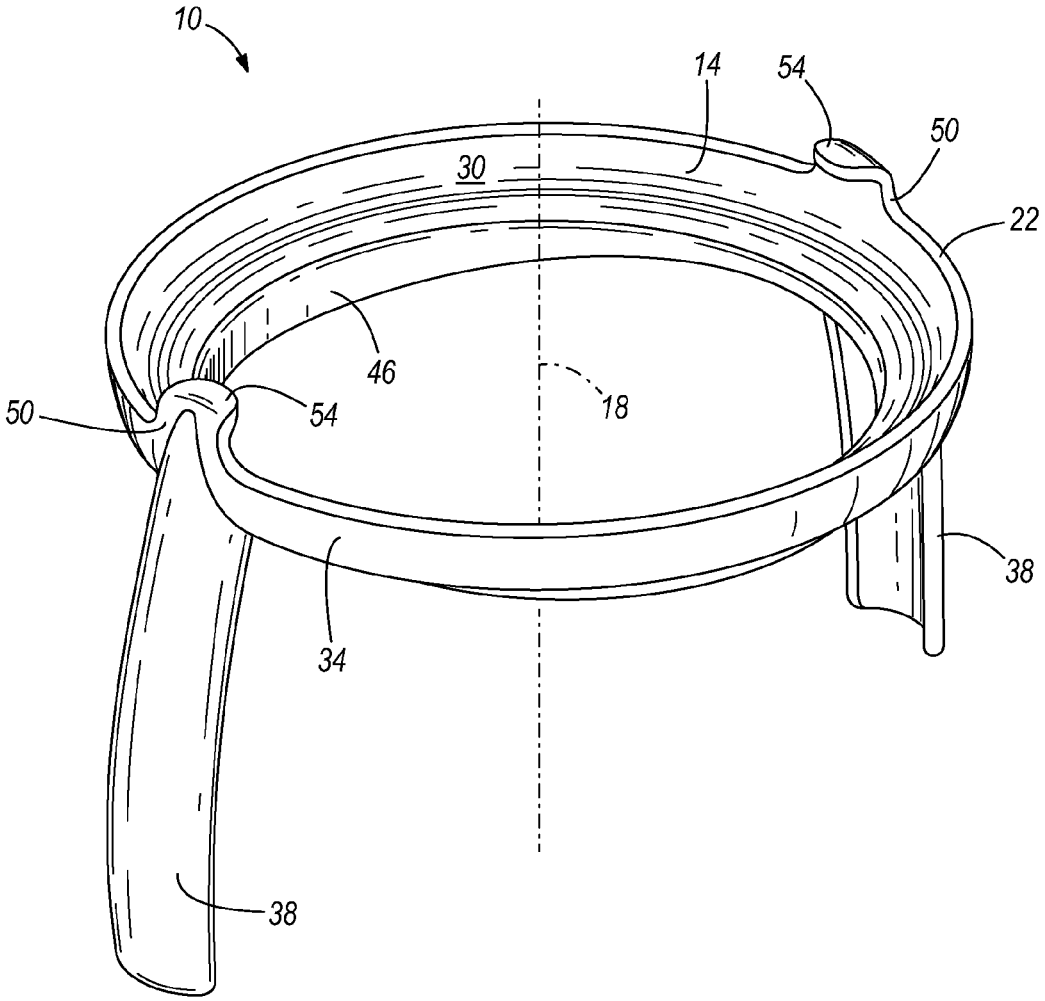
FIG. 1 is a perspective view of a detachable handle for a child's drinking device.
Figure 2:
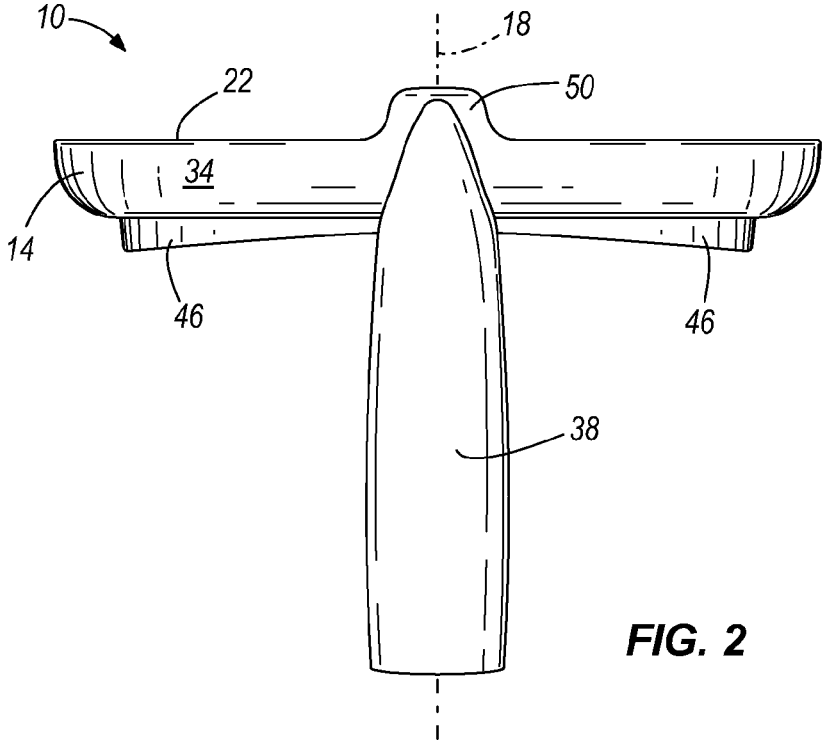
FIG. 2 is a side view of the detachable handle of FIG. 1.
Figure 3:
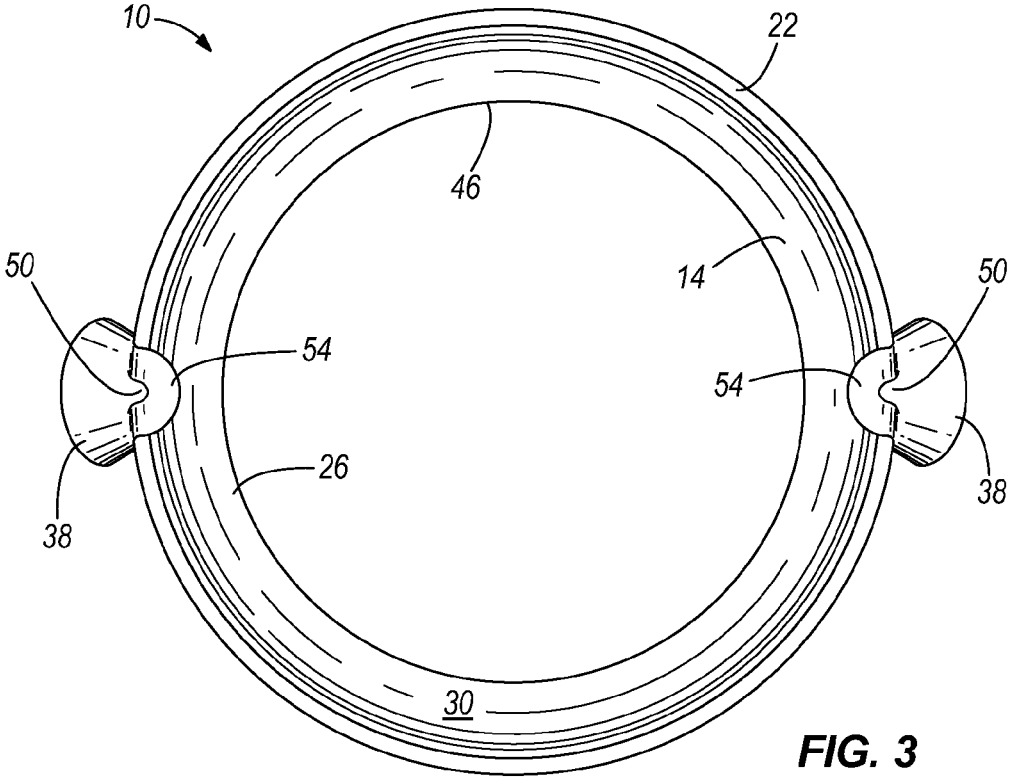
FIG. 3 is a top view of the detachable handle of FIG. 1.

Before at least one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways.

DETAILED DESCRIPTION

Referring to FIGS. 1-3 and 7, a detachable handle 10 for a child's sippy cup is illustrated. The handle 10 includes an annular ring portion 14 that defines a central axis 18. The ring portion 14 has an arcuate cross-section substantially in the form of a quarter-circle. The ring portion 14 defines an upper edge 22, and a lower edge 26. An upwardly and radially inwardly facing concave inner surface 30, and a downwardly and radially outwardly facing convex outer surface 34 extend between the upper and lower edges 22, 26.

Grasping portions 38 extend axially downwardly and radially outwardly from the outer surface 34. The grasping portions 38 are substantially diametrically opposed from one another with respect to the central axis 18. The illustrated grasping portions 38 have a substantially semi-circular cross section, however the grasping portions 38 can take on substantially any suitable form including cylindrical, semi-cylindrical, rectangular, and the like. Flange portions 46 (best illustrated in FIG. 2) extend generally axially downwardly from the lower edge 26. The flange portions 46 have a varying axial length about the circumference of the lower edge 26 and are configured such that the axial length is shortest adjacent the grasping portions 38, and longest at a position approximately mid-way between the grasping portions 38. The variable axial length of the flange portions 46 provide a variable stiffness about the ring portion 14, which in turn provides for variable deformation of the ring portion 14 during attachment and detachment of the handle 10 and the sippy cup, as discussed further below. While a variety of materials may be suitable for construction of the handle 10, the use of a polypropylene, such as px617, is particularly appropriate because it provides adequate durability, strength, resilience, flexibility, and ease of cleaning.

The handle 10 also includes a pair of hook portions 50. The hook portions 50 extend substantially axially from the upper edge 22 and, in the illustrated construction, are substantially radially aligned with the grasping portions 38. The hook portions 50 are substantially diametrically opposed from one another with respect to the central axis 18. Each hook portion 50 includes a radially inwardly extending lip 54. When the handle 10 is attached to the sippy cup, the lips 54 and the inner surface 30 engage the sippy cup and cooperate to limit movement of the handle 10 with respect to the sippy cup in the axial direction, as discussed further below. The handle 10 is deformable such that movement of the grasping portions 38 radially inwardly toward the central axis 18 causes the hook portions 50 and inwardly extending lips 54 to move radially outwardly, away from the central axis 18, as indicated by the arrows in FIG. 7.

Referring also to FIGS. 4-6 and 8, the handle 10 is illustrated coupled to an exemplary form of a child's sippy cup. The sippy cup includes a lower cup portion 58 and an upper lid portion 62. The cup portion 58 is configured to contain a beverage, and the lid portion 62 is detachably engageable with the cup portion 58 at an interface 66. In the illustrated construction, the interface 66 is configured to provide a sealing, snap fit engagement between the cup portion 58 and lid portion 62 such that when the lid portion 62 is coupled to the cup portion 58, the interface 66 is substantially leak-proof.

The lid portion 62 includes an upper surface 68 and a drinking portion in the form of a spout 70. In the illustrated construction, the upper surface 68 is convex and substantially annular. It should be appreciated however that the upper surface can take on a variety of shapes and forms depending upon, among other things, the configuration of the interface 66 and the lid portion 62. The illustrated drinking spout 70 extends generally axially away from the cup portion 58, however in alternative constructions the drinking spout 70 may be defined by one or more recesses formed in the lid portion 62.

The illustrated drinking spout 70 includes an end 74 that defines a plurality of apertures 78 (see FIG. 6) through which the beverage flows when suction is applied to the end 74 of the drinking spout 70. It should be appreciated that the upper surface 68, the apertures 78 and the drinking spout 70 can be configured and adapted to function in a variety of ways, and that the illustrated construction of the upper surface 68, the apertures 78, and drinking spout 70 should not be regarded as limiting with respect to the present invention.

Figure 4:
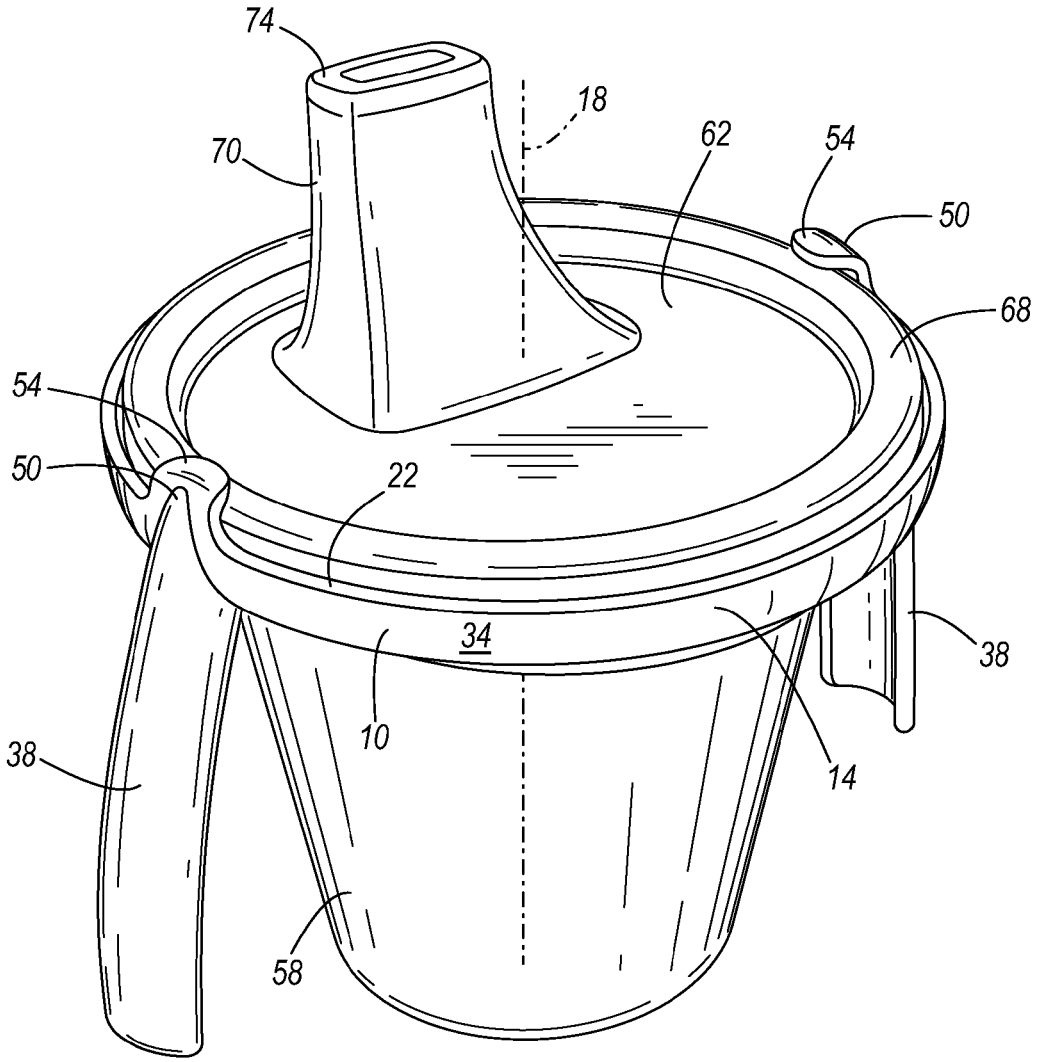
FIG. 4 is a perspective view of child's drinking device including the detachable handle of FIG. 1.
Figure 5:
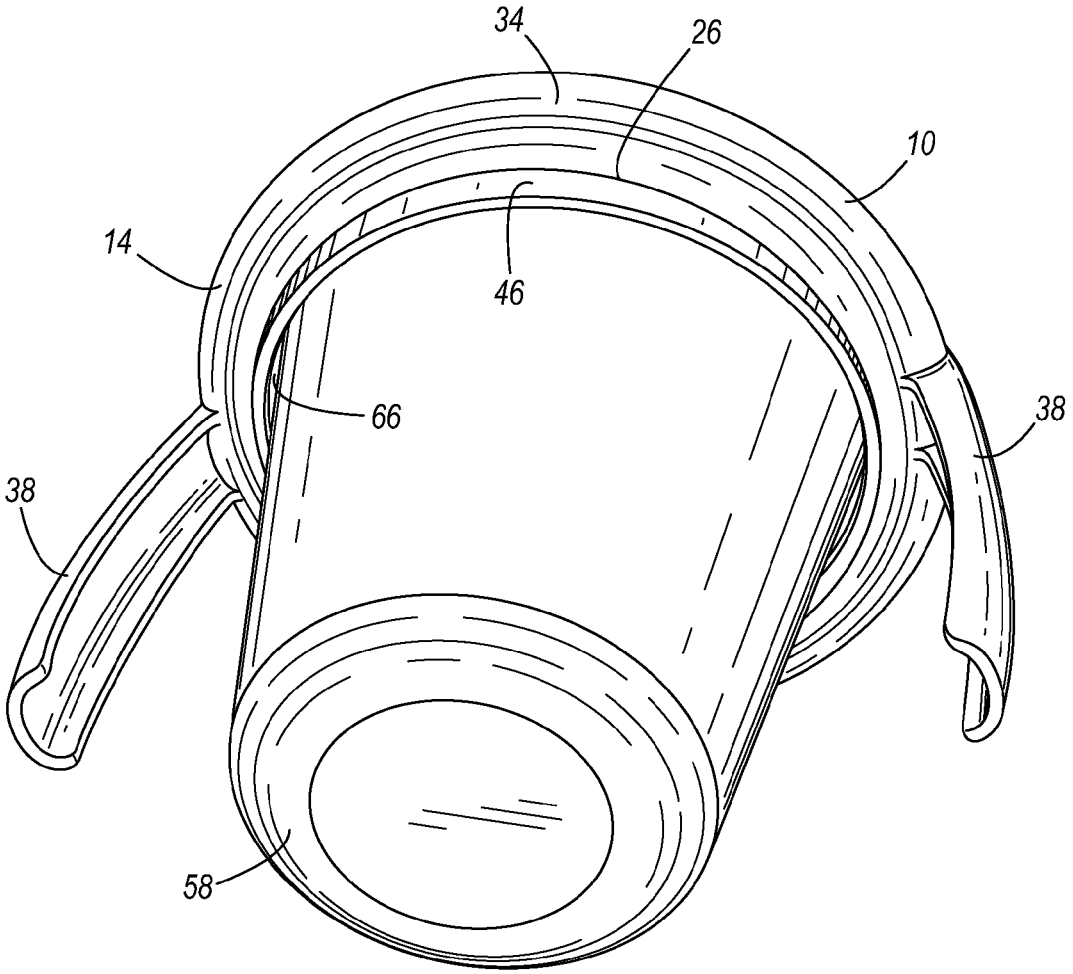
FIG. 5 is an alternate perspective view looking up from the bottom of the cup of the child's drinking device of FIG. 4, including the detachable handle of FIG. 1.
Figure 6:
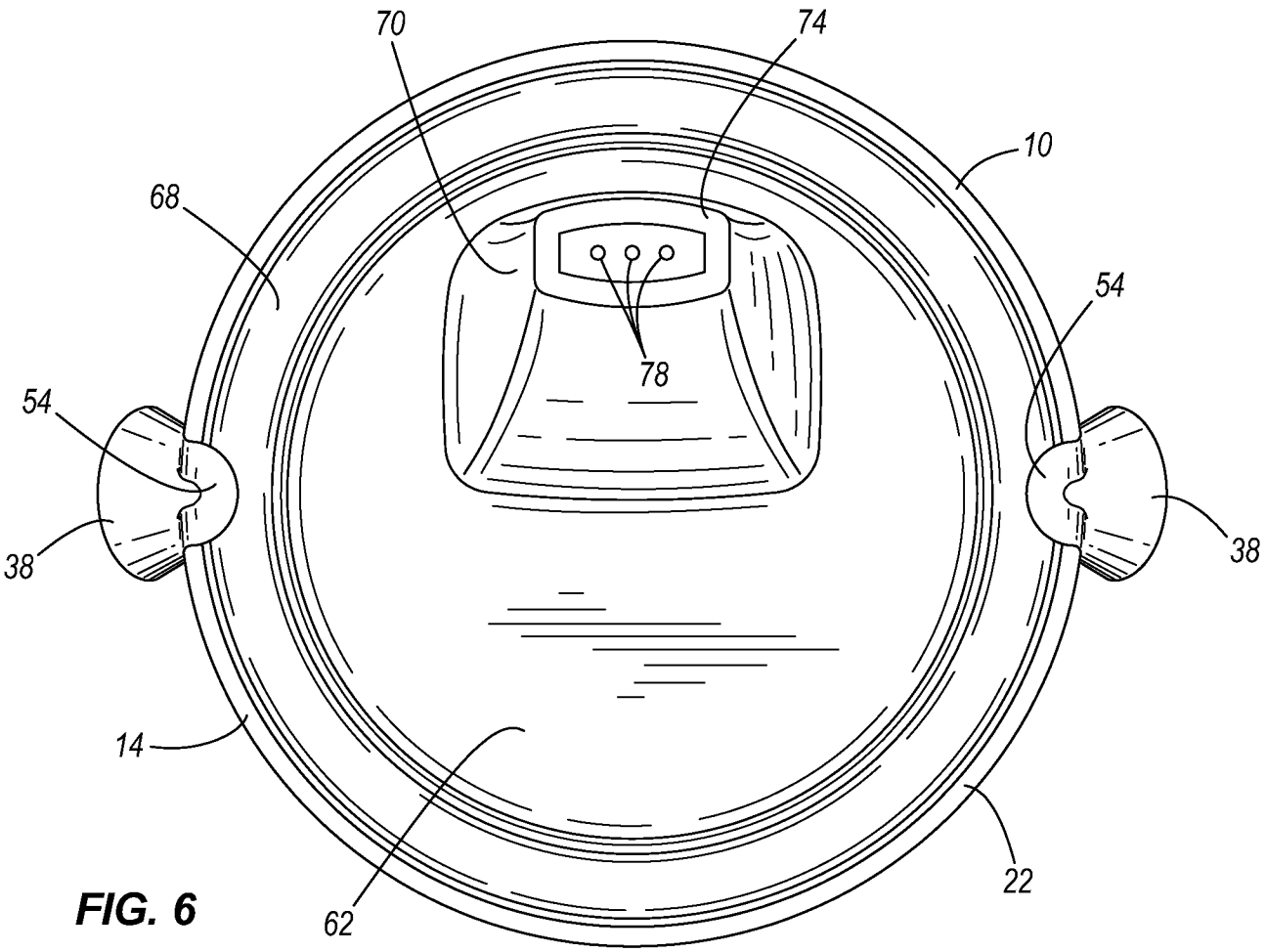
FIG. 6 is a top view of the child's drinking device of FIG. 4, including the detachable handle of FIG. 1.

As illustrated in FIGS. 4-6, when the handle 10 is coupled to the sippy cup, the cup portion 58 extends axially through the ring portion 14, the interface 66 is substantially surrounded by the ring portion 14, and the lips 54 of the hook portions 50 engage the upper surface 68 of the lid portion 62. More specifically, engagement between the lips 54 and the upper surface 68 limits axial movement of the handle 10 with respect to the cup and lid portions 58, 62 in a first direction (e.g. downwardly when the cup portion 58 is resting upon a support surface). Similarly, engagement between the inner surface 30 and at least one of the cup portion 58 and the lid portion 62 below and/or substantially adjacent to the interface 66 limits axial movement of the handle 10 in a second, opposite direction (e.g. upwardly when the cup portion 58 is resting on a support surface). Thus, the cup and lid portions 58, 62 are firmly grasped between the hook portions 50 and the inner surface 30 of the handle 10 along the interface 66 to detachably secure the handle 10 to the cup and lid portions 58, 62. Furthermore, when the handle 10 is coupled to the cup and lid portions 58, 62, the lid portion 62 generally cannot be removed from the cup portion 58.

In the illustrated construction, the handle 10 is rotatable with respect to the cup and lid portions 58, 62, about the central axis 18. However, other constructions can include ribs or grooves provided along one or both of the cup portion 58 and the lid portion 62 for engagement with the handle 10 to prevent or limit rotation of the handle 10 about the central axis 18. In addition, alternative constructions of the handle 10 may include a plurality of radially spaced apart ribs extending axially inwardly from the inner surface 30. The ribs may include upper surfaces extending substantially perpendicular to the central axis 18 and spaced a distance from the upper edge 22 of the ring portion 14. In this alternative construction, the upper surfaces of the ribs engage at least one of the cup portion 58 and the lid portion 62 instead of the inner surface 30.

To detach the handle 10 from the cup and lid portions 58, 62, the grasping portions 38 are urged radially inwardly toward the central axis 18. Urging the grasping portions 38 in this manner causes the handle 10 to deform such that the hook portions 50 move radially outwardly (see FIG. 7). While the deflection of the ring portion 14 and the precise movements of the hook portions 50 and grasping portions 38 are more complex, the grasping portions 38 and the hook portions 50 generally pivot about the lower edge 26 of the ring portion 14, where the axial lengths of the respective flange portions 46 are at a minimum. As the hook portions 50 move radially outwardly, the lips 54 move out of engagement with the upper surface 68 of the lid portion 62 such that the handle 10 can be removed from the cup and lid portions 58, 62 by moving the handle 10 axially downward toward the cup portion 58. As illustrated in FIG. 8, detachment of one of the lips 54 may occur before detachment of the other of the lips 54, such that movement of the handle 10 is generally, though not exclusively axial. As the handle 10 is moved axially downward, both lips 54 pass by the interface 66 until the handle 10 is completely disengaged from both the cup portion 58 and the lid portion 62.

Figure 7:
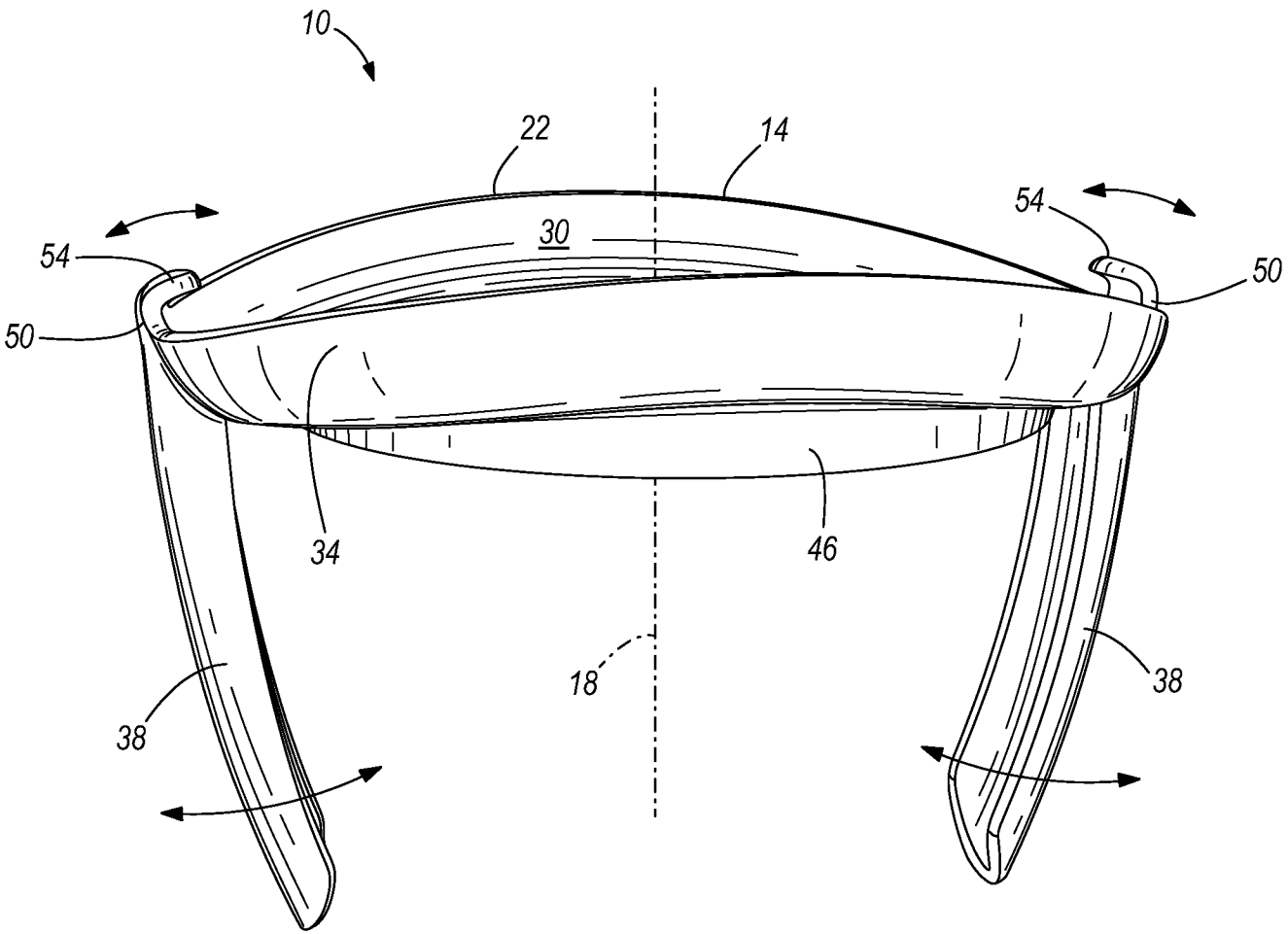
FIG. 7 is a perspective view of the detachable handle in a deformed condition.
Figure 8:
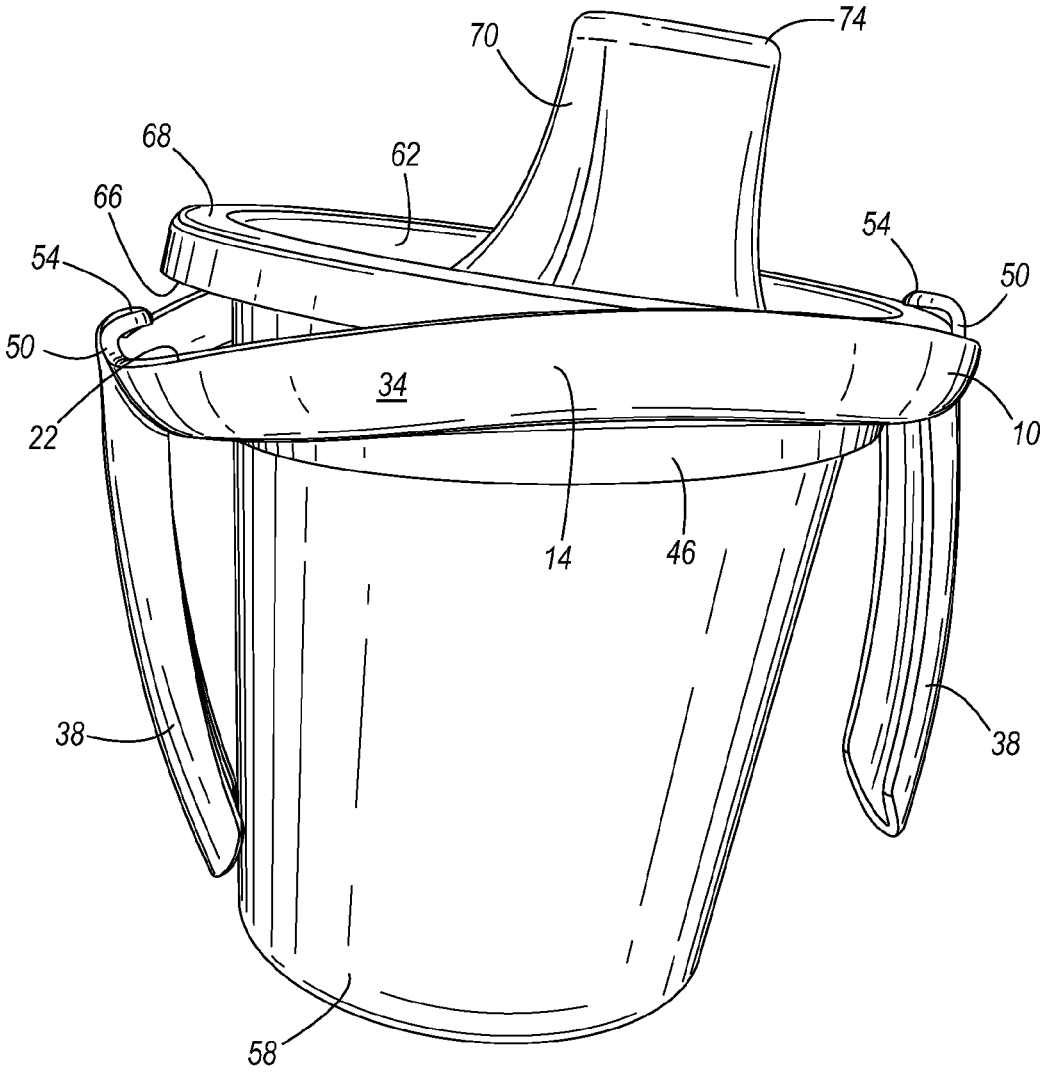
FIG. 8 is a perspective view of the child's drinking device of FIG. 4, including the detachable handle of FIG. 1, and showing the detachable handle in a partially attached position.

To engage the handle 10 with the sippy cup, the grasping portions 38 are urged radially inwardly toward the central axis 18, thereby moving the hook portions 50 radially away from the central axis 18 and one another (see FIG. 7). With the inner surface 30 facing the cup portion 58, the cup portion 58 is extended through the ring portion 58 such that the interface 66 is received by the ring portion 14. With the grasping portions 38 held radially inwardly and the hook portions 50 spaced radially outwardly, the handle 10 is maneuvered such that hook portions 50 move axially past the interface 66, and such that such at least one of the cup portion 58 and the lid portion 62 engages the inner surface 30. As illustrated in FIG. 8, one of the hook portions 54 can be engaged with the upper surface of the lid portion 68 before the other hook portion is moved past the interface 66. The grasping portions 38 are then released and move radially outwardly as the ring portion 14 returns to a non-deformed shape, due at least in part to the resiliency of its construction material. As the grasping portions 38 move radially outwardly, the hook portions 50 move radially inwardly and the lips 54 engage the upper surface 68 of the lid portion 62. As discussed above, engagement between the lips 54 and the upper surface 68, along with engagement between the inner surface 30 and the cup portion 58 and/or the lid portion 62, substantially prevents axial movement of the handle 10 with respect to the sippy cup.

Figure 9:
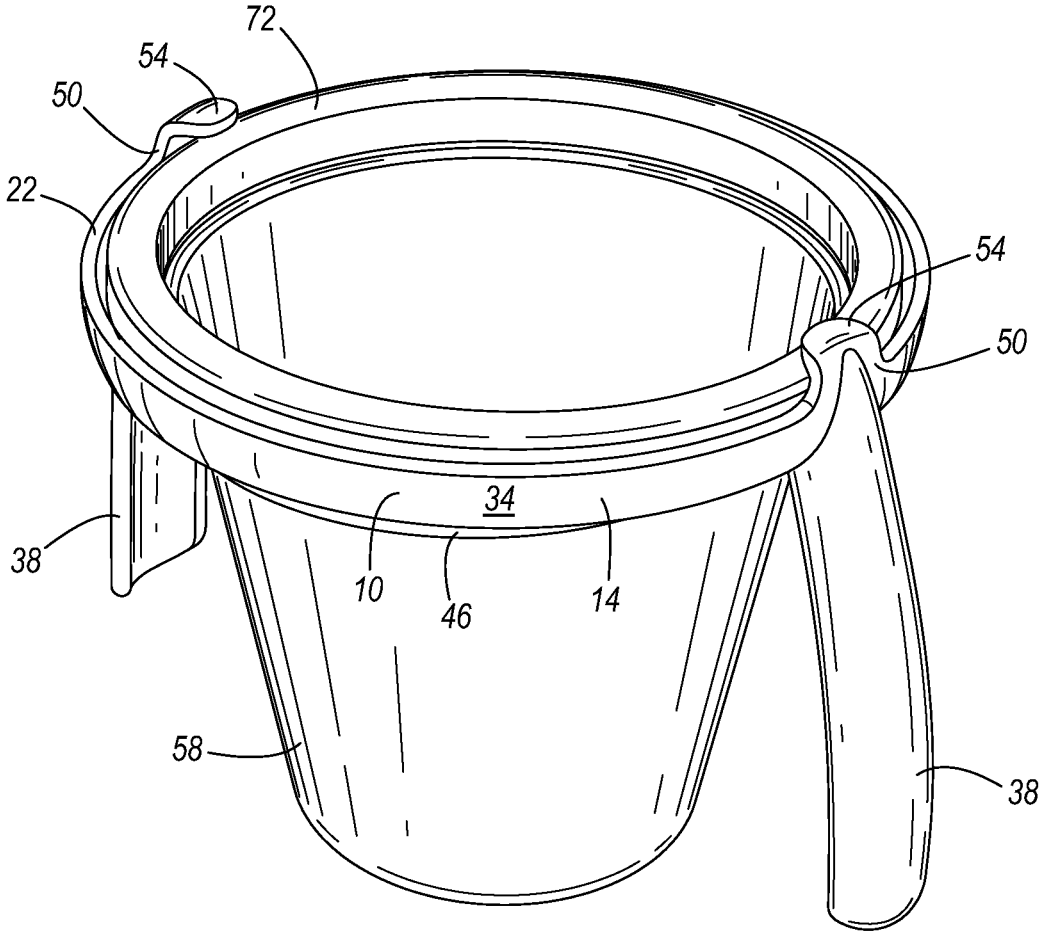
FIG. 9 is a perspective view of the child's drinking device of FIG. 4, including the detachable handle of FIG. 1, with a lid portion removed.

Referring also to FIG. 9, the handle 10 can also be attached to the cup portion 58 when the lid portion 62 is removed. In the illustrated construction, the cup portion 58 includes an upper surface 72 configured similarly to the upper surface 68 of the lid portion 62. When the lid portion 62 is removed from the cup portion 10, the handle 10 can be attached and detached from the cup portion 10 in substantially the same manner as discussed above. When the lid portion 62 is removed, the lips 54 of the handle 10 engage the upper surface 72 of the cup portion 58, instead of the upper surface 68 of the lid portion 62, to substantially prevent downward axial movement of the handle 10 with respect to the cup portion 58.

Although particular constructions of the present invention have been shown and described, other alternative constructions will be apparent to those skilled in the art and are within the intended scope of the present invention.

The invention claimed is:

1. A detachable handle for a child's drinking container, the handle comprising:

a ring portion defining an axis and adapted to receive the drinking container;

a pair of hook portions depending from the ring portion; and a pair of grasping portions depending from the ring portion, wherein the hook portions move in response to movement of the grasping portions to afford detachment of the handle from the drinking container, wherein the hook portions move radially away from the axis in response to movement of the grasping portions radially toward the axis.

2. The detachable handle of claim 1, wherein the ring portion is substantially circular.

3. The detachable handle of claim 1, wherein the hook portions are substantially opposed to one another relative to the axis, and wherein each grasping portions is substantially aligned with a respective one of the hook portions.

4. The detachable handle of claim 1, wherein the ring portion includes an arcuate cross section and defines an inwardly facing concave surface and an outwardly facing convex surface, and wherein the grasping portions extend axially from the outwardly facing convex surface.

5. The detachable handle of claim 1, wherein the ring portion includes an upper edge, wherein the hook portions depend substantially axially from the upper edge, and wherein the grasping portions depend substantially axially from the ring portion in a direction opposite the hook portions.

6. The detachable handle of claim 5, wherein each hook portion includes a radially inwardly extending lip.

7. The detachable handle of claim 5, wherein the ring portion includes a lower edge, the handle further comprising a pair of flange portions, each flange portion extending axially from a respective portion of the lower edge between the hook portions.

8. The detachable handle of claim 7, wherein each flange portion includes a varying axial length that is shortest adjacent the hook portions.

9. A child's drinking container comprising:

a cup defining an opening and an axis, the cup including a rim at an upper end thereof, the rim having an outer surface and an inner surface defining a recess at least partially around the upper end of the cup;

a lid removably coupled to the rim of the cup to overlie the opening, the lid defining a drinking portion; and a handle removably coupled to at least one of the cup and the lid, wherein when the handle is coupled to at least one of the cup and the lid, the handle substantially prevents removal of the lid from the cup, wherein the handle includes a ring portion that substantially surrounds the opening, a hook portion extending axially from the ring portion and engaging the lid, and a grasping portion extending axially from the ring in a direction opposite the hook portion, and wherein the hook portion moves radially away from the axis in response to movement of the grasping portion radially toward the axis, thereby at least partially disengaging the hook portion from the lid.

10. The child's drinking container of claim 9, wherein the handle is rotatable about the axis when the handle is coupled to at least one of the cup and the lid.

11. The child's drinking container of claim 9, wherein the handle is removable while the lid is coupled to the cup.

12. The child's drinking container of claim 9, wherein the handle is a single piece and is formed of a flexible, resilient material, and wherein the handle is coupled to and removed from at least one of the cup and the lid by deforming the handle.

13. The child's drinking container of claim 9, wherein the lid is coupled to the cup along an interface, and wherein when the handle is coupled to at least one of the cup and the lid, a first portion of the handle engages the lid on one side of the interface, and a second portion of the handle engages at least one of the cup and the lid on a second side of the interface.

14. The child's drinking container of claim 13, wherein the first portion of the handle includes a pair of hook portions, and the second portion of the handle includes an engagement surface.

15. The child's drinking container of claim 14, wherein the handle includes an annular ring portion that defines the engagement surface, and that substantially surrounds the interface when the handle is coupled to at least one of the cup and the lid, and wherein the hook portions extend substantially axially from the annular ring portion and are substantially diametrically opposed to one another.

16. The child's drinking container of claim 15, wherein the handle includes a pair of grasping portions extending from the annular ring portion.

17. The child's drinking container of claim 16, wherein each grasping portion is substantially radially aligned with a respective one of the hook portions, and wherein movement of the grasping portions relative to the axis causes radially outward movement of the hook portions to afford coupling and removal of the handle.

* * * * *